United States Patent [19]

Pitt et al.

[11] Patent Number: 4,988,610

[45] Date of Patent: Jan. 29, 1991

[54] HYDROPHILIC COLLOID COMPOSITIONS FOR PHOTOGRAPHIC MATERIALS

[75] Inventors: Alan R. Pitt, Hertfordshire; John T. Wear; Rachel Richardson, both of Middlesex; David Young, Hertfordshire, all of England

[73] Assignee: Eastman Kodak Company, Rochester, N.Y.

[21] Appl. No.: 358,211

[22] Filed: May 30, 1989

[30] Foreign Application Priority Data

Jul. 26, 1988 [GB] United Kingdom ..... 8817811

[51] Int. Cl.[5] ..... G03C 5/24

[52] U.S. Cl. ..... 430/449; 430/634; 430/546; 560/151; 560/145; 252/356; 252/354

[58] Field of Search ..... 430/634, 546, 449; 560/151, 145; 252/356, 354

[56] References Cited

U.S. PATENT DOCUMENTS

| | | | |
|---|---|---|---|
| 2,315,375 | 3/1943 | Nawiasky et al. | 560/151 |
| 2,345,041 | 3/1944 | Ericks et al. | 260/481 |
| 2,416,051 | 2/1947 | Gilbert Jr. | 117/121 |
| 2,619,500 | 11/1952 | Chiddix et al. | 260/481 |
| 2,679,528 | 5/1954 | De Groote | 260/481 |
| 2,679,529 | 5/1954 | DeGroste | 260/481 |
| 2,785,134 | 3/1957 | Matthews et al. | 252/161 |
| 3,201,252 | 8/1965 | Knox et al. | 96/94 |
| 3,236,627 | 2/1966 | Lindner | 71/3 |
| 3,661,794 | 5/1972 | Aignesberger | 252/354 |
| 3,762,928 | 10/1973 | Willems | 96/114.5 |
| 3,912,517 | 10/1975 | Van Pouke et al. | 430/546 |
| 3,936,303 | 2/1976 | Shiba et al. | 96/74 |
| 3,948,663 | 4/1976 | Shiba et al. | 430/546 |
| 4,119,465 | 10/1978 | Matsuda et al. | 96/75 |
| 4,201,586 | 5/1980 | Hori et al. | 430/621 |
| 4,347,308 | 8/1982 | Takeuchi et al. | |
| 4,385,110 | 5/1983 | Yoneyama et al. | 430/372 |

FOREIGN PATENT DOCUMENTS

| | | |
|---|---|---|
| 0015592 | 9/1980 | European Pat. Off. |
| 551246 | 2/1943 | United Kingdom |
| 1216084 | 12/1970 | United Kingdom |
| 1254548 | 11/1971 | United Kingdom |

OTHER PUBLICATIONS

Japanese Patent Application 19042/1981 "Method for Dispersing Photographic Additive".

*Primary Examiner*—Paul R. Michl
*Assistant Examiner*—Thomas R. Neville
*Attorney, Agent, or Firm*—Paul A. Leipold

[57] ABSTRACT

The invention provides a composition comprising a hydrophilic colloid and a surface active agent characterised in that the surface active agent is a compound having the formula

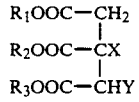

wherein each of $R_1$, $R_2$ and $R_3$ independently is a substituted or unsubstituted alkyl group or a substituted or unsubstituted aryl group;

each of X and Y is —H or $—Q^-M^+$;

$Q^-$ is an anion; and, $M^+$ is a cation;

provided that when X is —H, Y is $—Q^-M^+$ and that when X is $—Q^-M^+$, Y is —H.

Preferred surface active agents include compounds of the above formula wherein $R_1$, $R_2$ and $R_3$ are identical.

The anion $Q^-$ is a negatively charged atom or group of atoms preferably comprising a sulphonate group, such as $—SO_3^-$ or $—CH_2SO_3^-$ or a sulphate group, such as $—OSO_3^-$.

The cation $M^+$ is a positively charged atom or group of atoms preferably chosen from alkali metal cations, such as $Na^+$ or ammonium.

11 Claims, No Drawings

HYDROPHILIC COLLOID COMPOSITIONS FOR PHOTOGRAPHIC MATERIALS

FIELD OF THE INVENTION

The invention relates to hydrophilic colloid compositions suitable for use in the preparation of photographic materials.

PRIOR ART

In the preparation of a photographic material, it is usual to coat a support with one or more layers comprising an aqueous solution of a hydrophilic colloid binder, preferably, gelatin. Such layers include, for example, silver halide emulsion layers, intermediate layers, antihalation layers, filter layers, antistatic layers and protective layers. Such layers normally contain one or more surface active agents.

A number of photographic additives used in light-sensitive photographic materials are hydrophobic. Oil-soluble additives may be incorporated in the material by dissolving them in a substantially water-insoluble, high boiling point solvent which is then dispersed in an aqueous solution of the hydrophilic colloid. The formation of the dispersion may be facilitated by using an appropriate surface active agent, commonly referred to as a dispersing aid. Such oil-soluble additives include image dye-forming couplers, dye stabilizers, antioxidants and ultra-violet radiation absorbing agents. Processes for dispersing oil-soluble photographic additives are well known in the art.

In addition to their use as dispersing aids, surface active agents may be used as coating aids in the preparation of photographic materials. In producing the thin hydrophilic colloid layers of photographic materials, it is required that coating solutions are coated uniformly without the formation of repellency spots or craters, hereinafter referred to as repellencies. A repellency is a round, oval-shaped or comet-shaped indentation or crater in the coated layer and is usually produced by the presence of small particles or droplets of insoluble materials in the form of addenda, impurities or contaminants which are in contact with the uppermost liquid-air interface of the coated layer and are capable of reducing the surface tension of the liquid-air interface during the coating process.

A wide variety of surface active agents have been described for use in the preparation of photographic materials. For example, U.S. Pat. No. 3,948,663 describes photographic materials containing certain sulphosuccinate surface active agents and refers to their possible use as dispersing aids and coating aids. A specific example of such a surface active agent is sodium dioctyl sulphosuccinate which is commercially available as Aerosol OT from Cyanamid of Great Britain Ltd.

A problem associated with a hydrophobic additive such as a photographic dye-forming coupler dispersed in a hydrophilic colloid is that there is a tendency for the additive to crystallise. Additional problems associated with the incorporation of surface active agents in photographic materials relate to their effect on the sensitometric properties of the material. For example, Dmax, Dmin and contrast ($\gamma$) may be adversely affected.

THE INVENTION

The present invention aims to reduce the adverse effects mentioned above through the use of particular surface active agents.

The invention provides a composition comprising a hydrophilic colloid and a surface active agent characterised in that the surface active agent is a compound having the formula

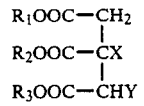

wherein each of $R_1$, $R_2$ and $R_3$ independently is a substituted or unsubstituted alkyl group or a substituted or unsubstituted aryl group;

each of X and Y is —H or $—Q^-M^+$;

$Q^-$ is an anion; and, $M^+$ is a cation;

provided that when X is —H, Y is $—Q^-M^+$ and that when X is $—Q^-M^+$, Y is —H.

Preferred surface active agents include compounds of the above formula wherein $R_1$, $R_2$ and $R_3$ are identical.

The anion $Q^-$ is a negatively charged atom or group of atoms preferably comprising a sulphonate group, such as $—SO_3^-$ or $—CH_2SO_3^-$ or a sulphate group, such as $—OSO_3^-$.

The cation $M^+$ is a positively charged atom or group of atoms preferably chosen from alkali metal cations, such as $Na^+$ or ammonium.

MODES OF PERFORMING THE INVENTION

The preferred hydrophilic colloid is gelatin e.g. alkali-treated gelatin (cattle bone or hide gelatin) and acid-treated gelatin (pigskin gelatin) or a gelatin derivative e.g. acetylated gelatin and phthalated gelatin. Other suitable hydrophilic colloids include naturally occurring substances such as proteins, protein derivatives, cellulose derivatives e.g. cellulose esters, polysaccharides e.g. dextran, gum arabic, zein, casein and pectin, collagen derivatives, agar-agar, arrowroot and albumin. Examples of suitable synthetic hydrophilic colloids include polyvinyl alcohol, acrylamide polymers, maleic acid copolymers, acrylic acid copolymers, methacrylic acid copolymers and polyalkylene oxides.

The choice of particularly preferred surface active agents will depend on a variety of factors including the purpose for which they are incorporated in the hydrophilic colloid.

For example, the surface active agent may be used as a dispersing aid. A dispersion may be formed by a process comprising dispersing a hydrophobic material into an aqueous solution of a hydrophilic colloid in the presence of a surface active agent used in the invention.

A number of photographic additives used in light sensitive photographic materials are oil-soluble and are used by dissolving them in a substantially water-insoluble, high boiling point solvent which is then dispersed in a hydrophilic colloid aqueous solution with the assistance of a dispersing aid. Such oil-soluble additives include image-forming dye couplers, dye stabilizers, antioxidants and ultra-violet radiation absorbing agents. A typical solvent used to dissolve the additive is di-n-butyl phthalate. Processes for dispersing oil-soluble photographic additives are well known in the art.

When employed as a dispersing aid, the surface active agent may be used in an amount from 0.1 to 5, preferably from 0.5 to 3, more preferably from 0.9 to 2 weight percent based on the weight of the dispersion.

Particularly preferred surface active agents for use as dispersing aids have the formula given above wherein each of $R_1$, $R_2$ and $R_3$ is an alkyl group having from 5 to 7 carbon atoms or an alkyl group having from 2 to 4 carbon atoms which is substituted with a phenyl group.

Alternatively, the surface active agent may be used as a coating aid in the formation of a hydrophilic colloid layer. A method of making a material, such as a photographic sheet material, may include the step of coating a support with an aqueous composition comprising a hydrophilic colloid and a surface active agent used in the invention.

When used as a coating aid, the surface active agent may be present in an amount from 0.01 to 0.3, preferably from 0.05 to 0.2 weight percent based on the weight of the hydrophilic colloid coating composition.

Particularly preferred surface active agents for use as coating aids have the formula given above wherein each of $R_1$, $R_2$ and $R_3$ is an alkyl group having 5 or 6 carbon atoms.

With regard to the preferred surface active agents defined above, whether intended for use as dispersing aids or as coating aids, these compounds possess a preferred hydrophilic-lipophilic balance. Since $R_1$, $R_2$ and $R_3$ need not be the same hydrophobic group nor the same type of hydrophobic group, it will be recognised that other preferred compounds can be formulated by choosing other combinations of $R_1$, $R_2$ and $R_3$ groups which provide a similar overall hydrophilic-hydrophilic balance.

For example, combinations of alkyl groups having more or fewer carbon atoms than specified above may be used. Also, substituted alkyl or aryl groups may be used to provide preferred compounds e.g. fluoroalkyl groups. For example, other particularly preferred surface active agents have the above formula wherein each of $R_1$, $R_2$ and $R_3$ are chosen from $C_3F_7CH_2$—, $C_2F_5CH_2$—, $H(CF_2)_4CH_2$— and $C_2F_5(CH_2)_2$— groups.

Specific examples of preferred compounds are sodium sulphotricarballylates having the formula given above wherein $R_1$, $R_2$ and $R_3$ are identical and are represented by R as follows:

| Compound | R |
|---|---|
| 1 | $(C_2H_5)_2CHCH_2$— |
| 2 | n-$C_6H_{13}$— |
| 3 | 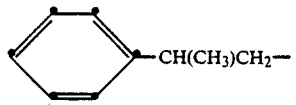 |
| 4 | 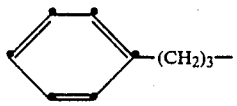 |
| 5 | 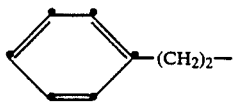 |

-continued

| Compound | R |
|---|---|
| 6 | n-$C_5H_{11}$— |
| 7 | $CH_3CH_2CH(CH_3)CH_2$— |
| 8 | $C_2F_5CH_2$— |

The hydrophilic colloid compositions of the invention are particularly suitable for use in the preparation of photographic materials. Thus, in a further aspect, the invention provides a photographic material comprising a support having thereon at least one layer comprising a hydrophilic colloid composition as described above. In one preferred embodiment, the layer comprises a photographic silver halide emulsion.

In the following discussion of suitable materials for use in the hydrophilic colloid compositions and photographic materials of this invention, reference will be made to Research Disclosure, Dec. 1978, Item 17643, published by Industrial Opportunities Ltd., The Old Harbourmaster's, 8 North Street, Emsworth, Hants P010 7DD, U.K., the disclosures of which are incorporated herein by reference. This publication will be identified hereafter as "Research Disclosure".

References giving information on couplers and on methods for their dispersions are given in Sections VII and XIV, respectively, of Research Disclosure.

The couplers commonly employed in photographic materials are water-insoluble compounds often containing ballast groups, phenolic (including naphtholic) couplers being used for producing cyan dyes and compounds containing an activated methylene group, including both heterocyclic and open-chain compounds, being used for producing magenta and yellow dyes. Important magenta couplers are pyrazolones and important yellow couplers are benzoylacetanilides. Patents describing couplers include the following U.S. Pat. Nos.:

Cyan dye-forming 3,367,531, 3,034,892, 2,423,730, 3,311,476, 2,474,293, 3,419,390, 2,772,826, 3,458,315, 2,895,826, 3,476,563.

Magenta Dye forming 2,343,703, 3,062,653, 2,369,489, 3,127,269, 2,600,788, 3,311,476, 2,908,573, 3,419,391, 2,933,391, 3,518,429.

Yellow dye-forming 2,298,443, 3,277,155, 2,407,210, 3,408,194, 2,875,057, 3,415,652, 2,908,573, 3,447,928, 3,265,506, 3,933,501.

An account of dye-forming development is given in 'Modern Photographic Processing', Vol. 2, Grant Haist, Wiley, N.Y., 1978, Chapter 9.

The hydrophilic colloid compositions are useful in any coupler-incorporated silver halide photographic materials, including monochrome materials, false-colour materials and colour transparency, negative and print materials. In such materials, image dye is obtained on development with a solution including a p-phenylenediamine colour developing agent. Such developing agents are well-known, being described in, for example *Photographic Processing Chemistry*, L. F. A. Mason, Focal Press, London, 2nd edition (1975) pp 229–235 and *Modern Photographic Processing*, Grant Haist, Wiley, N.Y. (1979), Volume 2 pp 463–8.

The silver halide emulsion employed in the material of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

The photographic material of this invention or individual layers thereof, can contain brighteners (see Research Disclosure Section V), antifoggants and stabilizers (see Research Disclosure Section VI), antistain agents and image dye stabilizer (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic material can be coated on a variety of supports as described in Research Disclosure Section XVII and the references described therein.

Photographic materials can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a colour developing agent to reduce developable silver halide and oxidize the colour developing agent. Oxidized colour developing agent in turn reacts with the coupler to yield a dye.

With negative working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The invention is further illustrated with reference to the following Examples.

EXAMPLE 1

A number of different surface active agents were tested as dispersing aids for oil-soluble dye-forming coupler compounds in the preparation of photographic materials.

The oil phase of the dispersion was prepared by mixing the following components at a temperature of 146° C.:

| | |
|---|---|
| Coupler | 87 g |
| Dibutyl phthalate | 44 g |
| 2-(2-butoxyethoxy)ethyl acetate | 13 g |
| Dioctyl hydroquinone | 9 g |
| Stabiliser | 37 g |

The coupler was a magenta dye-forming coupler having the following structure

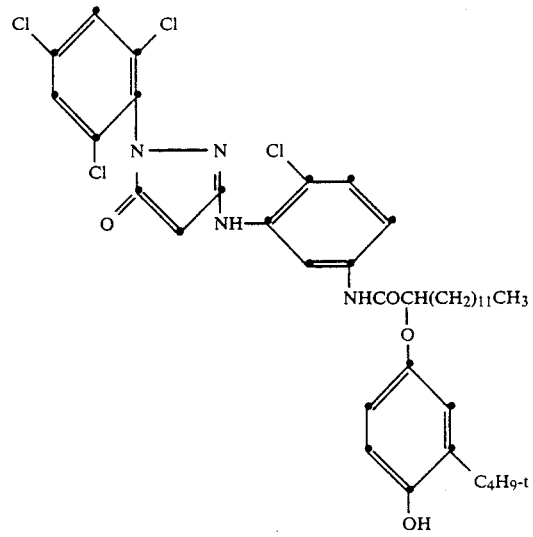

The stabiliser was a compound having the following formula:

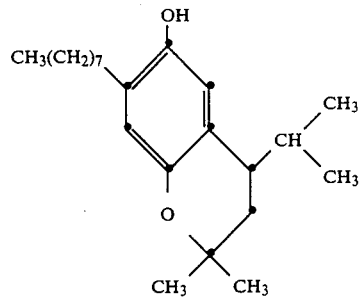

The aqueous phase of the dispersion was prepared by mixing the following components at a temperature of 88° C.:

| | |
|---|---|
| Dry gelatin | 87 g |
| Demineralised water | 612 g |
| Sodium hydroxide (2N) | 9 g |
| Propionic acid (2N) | 5 g |
| Surface active agent (10% by wt. solution) | 95 g |

In order to form the dispersion, the hot oil phase was initially poured into the aqueous phase. The mixture of oil and aqueous phases was then homogenized at a temperature of about 75° C. using conventional homogenizing equipment.

A coating composition was prepared by mixing the dispersion and a silver chlorobromide emulsion. The composition was coated on a support for testing as a single layer having a silver laydown of 504 mg/m$^2$ and a coupler laydown of 535 mg/m$^2$.

Coatings were prepared using each of the surface active agents being tested. In addition to using the above formulation containing 9.5 g surface active agent, coatings were prepared from formulations containing 19 g and 28.5 g surface active agent.

The coatings were exposed through a graduated density test object and developed using a standard Ektaprint-2 process (see British Journal of Photography Annual 1986, pages 37 and 38).

The contrast (γ) and Dmax of the processed coatings was measured soon after processing i.e. when the coatings were still fresh. Dmin was measured after 3 weeks exposure to light (SANS) and yellow Dmin was measured after 3 weeks storage in a wet oven at 60° C. and 70% relative humidity. The results are presented in table I below:

TABLE I

| Compound | Weight (g) | γ | Dmax | Dmin | Yellow Dmin |
|---|---|---|---|---|---|
| Aerosol OT | 9.5 | 2.61 | 2.52 | 0.08 | 0.17 |
| | 19.0 | dispersion too crystallised to coat | | | |
| | 28.5 | dispersion too crystallised to coat | | | |
| 1 | 9.5 | 2.65 | 2.76 | 0.09 | 0.15 |
| | 19.0 | 2.71 | 2.96 | 0.12 | 0.17 |
| | 28.5 | 2.80 | 3.00 | 0.05 | 0.16 |
| 2 | 9.5 | 2.47 | 2.62 | 0.03 | 0.14 |
| | 19.0 | 2.54 | 2.66 | 0.06 | 0.14 |
| | 28.5 | 2.64 | 2.76 | 0.07 | 0.15 |
| 3 | 9.5 | 2.45 | 2.52 | 0.04 | 0.13 |
| | 19.0 | 2.62 | 2.78 | 0.08 | 0.13 |
| 4 | 9.5 | 2.53 | 2.68 | 0.05 | 0.17 |
| | 19.0 | 2.70 | 2.91 | 0.10 | 0.17 |

The surface active agents used in the invention produced a significant improvement of Dmax by comparison with the Aerosol OT control. Significant increases in γ and Dmax were obtained as the concentration of the surface active agent was increased. Also, some improvements in Dmin and yellow Dmin are apparent.

The effect of the surface active agents on coupler crystallisation was also measured. Using an optical technique to detect the presence of crystals, the relative amount of coupler that had crystallised was measured on dispersions soon after preparation i.e. on fresh dispersions, and on the same dispersions which had been stored for 2 months. The results are shown in Table II below:

TABLE II

| Compound | Weight (g) | Relative Crystal Content of Dispersion | |
|---|---|---|---|
| | | Fresh | Stored |
| Aerosol OT | 9.5 | 0.41 | 0.49 |
| | 19.0 | too high to measure | |
| | 28.5 | too high to measure | |
| 1 | 9.5 | 0.08 | 0.23 |
| | 19.0 | 0.08 | 0.12 |
| | 28.5 | 0.08 | 0.15 |
| 2 | 9.5 | 0.08 | 0.15 |
| | 19.0 | 0.08 | 0.25 |
| | 28.5 | 0.13 | 0.31 |
| 3 | 9.5 | 0.23 | 0.31 |
| 4 | 19.5 | 0.15 | 0.23 |

The results show clearly that the use of the surface active agents in accordance with the invention leads to a significant reduction in coupler crystallisation when compared with the use of Aerosol OT.

EXAMPLE 2

Photographic dispersions were prepared comprising an oil phase and an aqueous phase.

The oil phase was prepared by mixing the following components at 139° C.:

| | |
|---|---|
| Coupler | 38.6 g |

-continued

| | |
|---|---|
| Dibutyl phthalate | 10.6 g |
| 2-(2-Butoxyethoxy)ethyl acetate | 2.9 g |

The coupler was a yellow dye-forming coupler having the following formula:

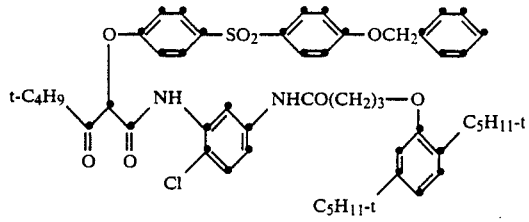

The aqueous phase was prepared by mixing the following components:

| | |
|---|---|
| Gelatin (dry) | 29.6 g |
| Surface active agent (0.006 mole in water) | 20.1 g |
| Demineralised water | 199.8 g |

In order to form the dispersion, the aqueous phase, pre-heated to 60° C., was added to the oil phase and the mixture was homogenised using conventional homogenising equipment.

The effect of a number of different surface active agents on coupler crystallisation was assessed by measuring the time lapse before the onset of crystallisation in the dispersions. The onset of crystallisation was detected using an optical technique.

The results are shown in the following Table III.

TABLE III

| Compound | Time (hrs) to onset of crystallisation | Relative time |
|---|---|---|
| Nekal BX | 210 | 1.0 |
| 5 | 360 | 1.7 |
| 3 | >800 | >3.8 |
| 4 | >900 | >4.3 |
| 2 | >1200 | >5.7 |

Nekal BX (available from BASF U.K. Ltd.) is nominally dibutyl naphthalene sulphonate, a conventional surface active agent used as a dispersing aid in the preparation of photographic dispersions.

The results show the marked reduction in coupler crystallisation achieved using the surface active agents employed in the invention.

EXAMPLE 3

Surface active agents were tested as coating aids in aqueous gelatin coating compositions.

The coatability was assessed by coating a pair of layers, the upper of which contained the surface active agent under test, onto a 12.7 cm (5 ins) width roll of polyethylene terephthalate film base suitably subbed to give good adhesion to gelatin. The bottom layer consisted of a 4% solution of a bone gelatin in water coated at 85.4 millilitres/m$^2$ and the top layer consisted of 2 parts 7% bone gelatin with a marker (a coloured dye), and 1 part of 7% gelatin solution (the gelatin being chosen as one that induces repellency, i.e. one containing natural fats) to which was added the surface active agent. The top layer was applied at 14.2 millilitres/$m^2$. Both layers were applied simultaneously at a temperature of 40° C. using a conventional double slide hopper with applied suction and at a linear coating speed of 30 m/min.

For each series of experiments, the surface active agent was used in amounts ranging from 0.03 to 0.10% by weight based on the weight of the coating solution for the top layer.

The results are summarised as follows in Table IV:

TABLE IV

| Compound | Concentration (wt. %) 0.03 | 0.05 | 0.10 |
|---|---|---|---|
| 1 | — | C | C |
| 6 | C | C | C |
| 7 | — | R | C |
| 8 | — | — | C |

In the Table, R denotes that the coating was covered in large numbers of repellencies while C denotes that no repellencies were produced i.e. complete control of repellencies was achieved. The results show that each of the surface active agents controlled repellencies at a concentration of 0.10 weight percent while some could be used successfully at even lower concentrations.

The invention has been described in detail with particular reference to preferred embodiments thereof, but it will be understood that variations and modifications can be effected within the spirit and scope of the invention.

We claim:

1. A composition comprising hydrophobic dye-forming coupler dispersed in hydrophilic gelatin colloid with the aid of a surface active agent characterised in that the surface active agent is a compound having the formula

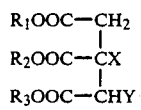

wherein each of $R_1$, $R_2$ and $R_3$ independently is a substituted or unsubstituted alkyl group or a substituted or unsubstituted aryl group;

each of X and Y is —H or —$Q^-M^+$;

$Q^-$ is an anion; and, $M^+$ is a cation;

provided that when X is —H, Y is —$Q^-M^+$ and that when X is —$Q^-M^+$, Y is —H.

2. A composition according to claim 1 wherein $R_1$, $R_2$ and $R_3$ are identical.

3. A composition according to claim 1 or claim 2 wherein the hydrophilic colloid comprises is gelatin.

4. A composition according to claim 1 wherein the hydrophobic particles comprise a photographic dye-forming coupler.

5. A composition according to claim 1 wherein each of $R_1$, $R_2$ and $R_3$ is an alkyl group having from 5 to 7 carbon atoms or an alkyl group having from 2 to 4 carbon atoms which is substituted with a phenyl group.

6. A composition according to claim 1 wherein each of $R_1$, $R_2$ and $R_3$ is an alkyl group having 5 or 6 carbon atoms.

7. A process for preparing a dispersion which comprises dispersing a hydrophobic dye-forming coupler material into an aqueous solution of hydrophilic gelatin colloid in the presence of a surface active agent characterised in that the surface active agent is a compound having the formula

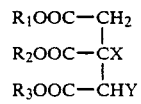

wherein each of $R_1$, $R_2$ and $R_3$ independently is a substituted or unsubstituted alkyl group or a substituted or unsubstituted aryl group;

each of X and Y is —H or —$Q^-M^+$;

$Q^-$ is an anion; and, $M^+$ is a cation;

provided that when X is —H, Y is —$Q^-M^+$ and that when X is —$Q^-M^+$, Y is —H.

8. A process according to claim 7 wherein the hydrophobic material is a solution of a photographic dye-forming coupler.

9. A photographic material comprising a support having thereon at least one layer comprising hydrophobic photographic additive particles a hydrophilic colloid composition, and a surface active agent characterized in that the surface active agent is a compound having the formula

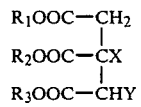

wherein each of $R_1$, $R_2$ and $R_3$ independently is a substituted or unsubstituted alkyl group or a substituted or unsubstituted aryl group;

each of X and Y is —H or —$Q^-M^+$;

$Q^-$ is an anion; and, $M^+$ is a cation;

provided that when X is —H, Y is —$Q^-M^+$ and that when X is —$Q^-M^+$, Y is —H.

10. The composition of claim 1 wherein said hydrophobic particles comprise photographic dye-forming coupler and said hydrophilic colloid comprises gelatin.

11. The process of claim 7 wherein said surface active agent comprises from 0.9 to 2 weight percent of said dispersion.

* * * * *

UNITED STATES PATENT AND TRADEMARK OFFICE

CERTIFICATE OF CORRECTION

PATENT NO. : 4,988,610

DATED : January 29, 1991

INVENTOR(S) : Alan R. Pitt et al

It is certified that error appears in the above-identified patent and that said Letters Patent is hereby corrected as shown below:

In Column 9, line 57, after "comprises", delete "is".

Signed and Sealed this

Sixteenth Day of June, 1992

*Attest:*

*Attesting Officer*

DOUGLAS B. COMER

*Acting Commissioner of Patents and Trademarks*